United States Patent [19]

Cahill

[11] Patent Number: 4,840,603

[45] Date of Patent: Jun. 20, 1989

[54] DOLL AND METHOD FOR PRODUCING A DOLL

[76] Inventor: Mary J. Cahill, 387 Cypress Ave., Sunnyvale, Calif. 94086

[21] Appl. No.: 45,609

[22] Filed: May 1, 1987

Related U.S. Application Data

[63] Continuation-in-part of Ser. No. 828,329, Jan. 17, 1986, which is a continuation-in-part of Ser. No. 662,839, Oct. 19, 1984, abandoned, which is a continuation-in-part of Ser. No. 610,959, May 16, 1984, Pat. No. 4,629,441.

[51] Int. Cl.[4] ..... A63H 3/02; A63H 3/36

[52] U.S. Cl. ..... 446/372; 446/391; 156/61

[58] Field of Search ..... 446/372, 369, 391, 392, 446/393, 394, 395, 268, 370, 371, 385; 428/16, 102; 156/306.6, 291, 292, 61, 63; 112/403, 420

[56] References Cited

U.S. PATENT DOCUMENTS

| | | | |
|---|---|---|---|
| 144,373 | 11/1873 | Walker | 446/268 |
| 285,448 | 9/1883 | Wellington | 222/613 |
| 366,730 | 7/1887 | Johnson | 446/369 |
| 505,679 | 9/1893 | Smith | 446/369 |
| 1,442,761 | 1/1923 | Beach | 446/372 |
| 1,790,872 | 2/1931 | McBee | 446/372 |
| 1,916,811 | 7/1933 | Schwartz | 446/372 X |
| 1,948,803 | 2/1934 | Sherrill | 446/372 |
| 2,078,809 | 4/1937 | Richman | 446/74 |
| 2,307,523 | 1/1943 | Maisel | 446/391 |
| 2,483,325 | 9/1949 | Sanders | 446/372 |
| 2,495,761 | 1/1950 | Platt | 156/306.6 X |
| 2,805,428 | 9/1957 | Buchman | 5/442 |
| 2,845,749 | 8/1958 | Mickman | 446/392 |
| 3,065,568 | 11/1962 | Reiss | 446/372 |
| 3,463,692 | 8/1969 | Brunner | 156/306.6 |
| 3,566,604 | 5/1972 | Coffet | 156/306.6 X |
| 3,758,358 | 9/1973 | Kuroda | 156/292 |
| 4,390,575 | 6/1983 | Kopp | 156/291 |
| 4,629,441 | 12/1986 | Cahill | 446/372 |

OTHER PUBLICATIONS

"Soft Darlin Dolls", (1983), pp. 1–2.

Foster, "Foster Children Soft Sculptured Dolls", (1982).

*Primary Examiner*—Mickey Yu

*Attorney, Agent, or Firm*—Poms, Smith, Lande & Ross

[57] ABSTRACT

The method of forming feaures in a fabric doll face includes outlining a feature on a front, stretchable piece of fabric with an adhesive. A middle cover of material that does not stretch is attached to the other side of the adhesive to attach the middle cover to the front piece of fabric. Filling material is inserted between the front piece of fabric and the middle cover inside the feature formed by the adhesive material. A rear piece of fabric is then attached to the front piece of fabric over the middle cover.

24 Claims, 2 Drawing Sheets

FIG. 1
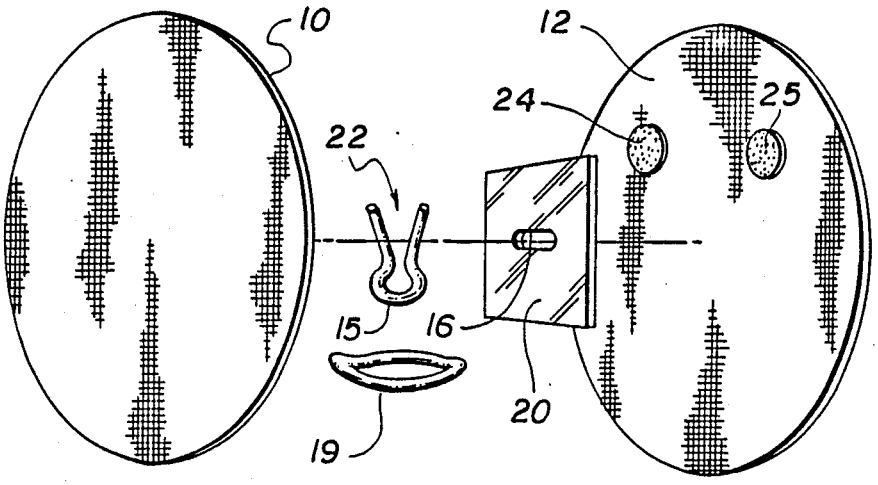
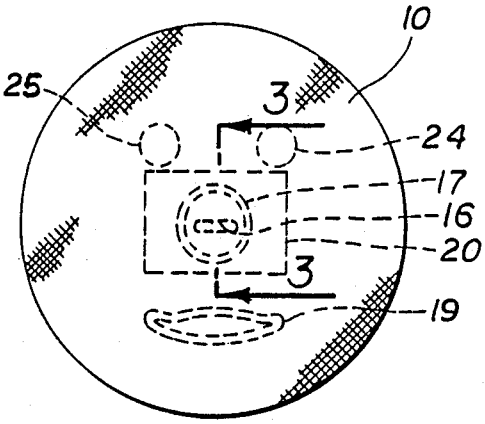
FIG. 2
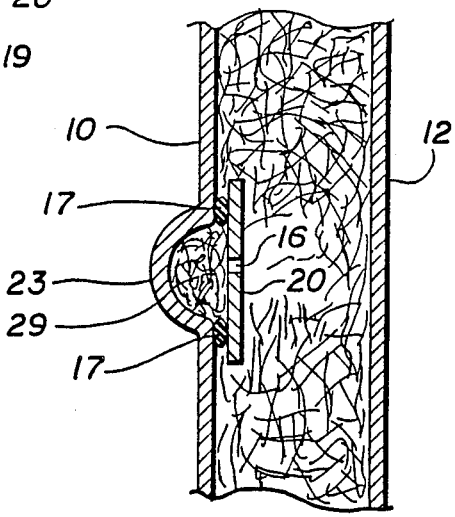
FIG. 3

DOLL AND METHOD FOR PRODUCING A DOLL

RELATED APPLICATIONS

This application is a continuation-in-part of applicant's prior application serial no. 828,329 filed Jan. 17, 1986, which was based on PCT application U.S. 85/00872 filed May 14, 1985. This application and the earlier applications are both continuations-in-part of applicant's application serial no. 662,839 filed Oct. 19, 1984; abandoned. The earlier applications are continuations-in-part of applicant's previous United States patent application Ser. No. 610,959 filed May 16, 1984 and now U.S. Pat. No. 4,629,441 dated Dec. 16, 1986.

BACKGROUND OF THE INVENTION

1. Field of the Invention:

The present invention relates (a) to a method for producing more outstanding, three dimensional facial features on a soft cloth doll and (b) to a doll and its face produced by the method. The method also has applicability for making three dimensional features in other cloth items.

2. The Prior Art:

Soft cloth dolls have been made for centuries. Many methods have been developed to produce facial features. All construct the basic head by filling a spherical, ellipsoidal or other similar shaped head cavity made of cloth with a soft substance such as down or fabric. The methods, which are explained in more detail in applicant's U.S. Pat. No. 4,629,441, fall within four categories: applique and embedment, needle modeling, trapunto and seamed heads and faces. Each of these methods can be used alone or together, but all suffer from an inability to form clear, life-like facial features without distracting stitches on the facial surface.

Applicant's earlier U.S. Pat. No. 4,629,441 discloses an improved method of forming a doll face. Desired features are outlined using meltable fuser attachments threads between a front and rear piece of fabric. The front piece stretches but the rear piece does not stretch. After the adhesive is made to hold the two sheets of fabric together, one inserts soft material between the two sheets of fabric within the outline of the feature. The front sheet bulges outward in the shape of the pattern.

Improvements in applicant's pending applications included using adhesive disks to form the eyes and surrounding the adhesive disks with a circular cord to make the eye sockets bulge. Another improvement used a sheet of adhesive material with various punched-out locations that could receive filling.

All of applicant's previous devices rely on the ability of the regions inside the fused locations to accept filling at high pressures so that the feature can be greatly packed to protrude further than other, less-pressurized regions. Because several adjacent features are formed, and these regions all have attachments holding the front and rear pieces of fabric together, the regions are stable. The stretchable front sheet of fabric allows the tightly packed features to protrude in a life-like manner as human lips, eyes and other parts of the face might do.

A minor drawback with applicant's previous doll faces occurs only when extremely great protrusion is desired. Although the front sheet of fabric is stretchable so it can protrude and the rear sheet does not stretch, the rear sheet is only backed by the filling of the head. Large general, forces on the rear sheet of fabric from the filling in the head tend to flatten the face to some degree so that the features do not protrude as much as may be desired.

SUMMARY OF THE INVENTION

It is an object of the present invention to disclose and provide a doll face and method of forming the face constructed in such a way that features protrude even further than with the previously discussed methods.

As in applicant's earlier methods, the face is formed with two face pieces of cloth, one of stretch fabric and the other which does not stretch, and the rest of the head is formed using a third, rear, head piece of cloth. The two face pieces and the rear head piece form a spherical or ellipsoidal head that is filled with soft material. The protruding features are formed by outlining the feature on the front, stretchable piece of fabric with an adhesive. One attaches a middle cover of material that does not stretch to the other side of the adhesive. Filling material is inserted between the front piece of fabric and the middle cover inside the feature formed by the adhesive material. Then one attaches a rear piece of fabric to the front piece of fabric over the middle cover. Other features may be formed between the front and rear sheets spaced from the cover. Additional filling material fills the space between the two sheets. Filling also is added spaced from the features to add definition to the face.

BRIEF DESCRIPTION OF THE DRAWINGS

FIG. 1 is an exploded view of the face of the present invention.

FIG. 2 is a front view of the face of the present invention.

FIG. 3 is a sectional view of part of the doll face of the present invention taken through plane 3—3 in FIG. 2.

DETAILED DESCRIPTION OF THE PREFERRED EMBODIMENTS

Figure 4:
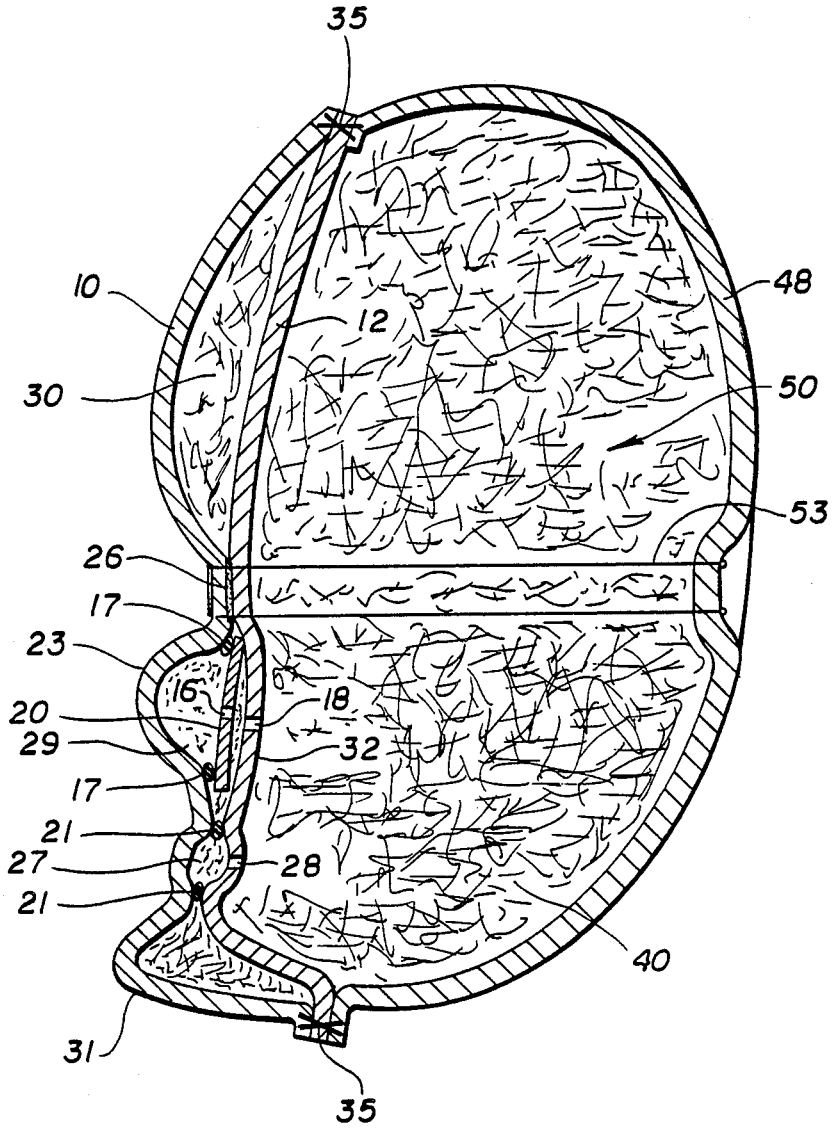
FIG. 4 is a sectional view of a doll head incorporating the completed face of the present invention.

Both applicant's earlier methods and the method of the present invention use two pieces of fabric for forming the face of the doll. The first, front piece 10 is stretch fabric, and the second, rear piece 12, does not stretch. The facial structure is also more mechanically stable if the rear cloth does not stretch. Features protrude more if the front sheet stretches.

Short pieces of polyamide fuser thread 15 and 19 (FIG. 1) or 17 and 19 (FIGS. 2-4) are placed on front sheet 10. Fuser thread 15 or 17 is the nose pattern, and fuser thread 19 is the mouth pattern. Two different nose shapes 15 and 17 are shown in the exemplary embodiments. Each feature is filled as explained below. The shape of fuser thread 15 approximates a nose, but it is open at the top and it may be more difficult to pack it tightly with filling. It is easier to pack the closed shape of fuser thread 17 (FIG. 2). Next, a small cover 20 is placed over a feature such as nose 15 or 17 that is to protrude extensively. The cover is preferably a small sheet of fabric, but it may be a sheet of other material. Minimum stretch is desirable, but it should not be hard material. When fuser thread 15 or 17 is correctly located on the rear of front sheet 10, the cover is heated with a clothing iron or other similar heating device. After a short time, the fuser thread melts and flows into and around the cloth fibers between front sheet 10 and cover 20 to create fine fused seams 17 (FIGS. 3 and 4).

Fuser threads are used because they are easily cut and controlled for adjusting the shape of the features. Only when the feature is in the exact desired shape is heat applied and the final attaching finished. Shaped fuser material, which is not in a thread, can also be used. Other strong and water resistant adhesives that are not set by heating are acceptable.

One can fill the cavity formed between cover 20, front sheet 10 and the outline of fuser thread 15 through the top of the outline 22 with soft material such as batting or down (FIG. 1). To use the closed pattern, a slit 16 is cut through the cover, and filling material is inserted through slot 16 causing a bulge 23 for the nose. The drawings show soft filler material, which may be made harder through tight packing. Hard material, such as rubber or compressed batting may be used.

Next, a pattern of fuser thread 19 and two eye disks 24 and 25 are placed on the front of rear sheet of fabric 12 or on the back of front sheet of fabric 10. The two sheets 10 and 12 are brought together and the region where the eye disks 24 and 25 and the mouth outline 19 are, are again heated with an iron or similar device. The fuser threads and disks melt and flow into and around the cloth fibers to create fine fused seams 21 and eyes 26 (FIG. 4). The mouth may be stitched instead of fused. Mouth cavity 27 (FIG. 4) between the front 10 and rear 12 pieces outlined by mouth seam 21 is filled with soft material through slit 28.

Using a single outline for the mouth as shown in the exemplary embodiment does not yield separate lips. One may paint the central portion of the mouth to create an illusion of separate lips. One or more additional pieces of fuser thread (not shown) may be placed generally horizontal extending to or near both corners of the mouth. Lip cavities are then formed and are filled using the same techniques.

The eyes may be created by embroidering eye designs or stitching a closed or partially closed figure and painting the designs at the desired location rather than using adhesive disks 24 and 25.

More filling is then inserted between front and rear sheets 10 and 12 at desired locations. Filling in area 30 forms the forehead, area 31 forms the chin, and area 32, behind cover 20 helps round the central portion of the face. Filling located in other regions of the face forms the cheeks and other facial features.

The outside periphery 35 of the front and rear pieces 10 and 12 are then stitched together to form a face. As FIG. 4 shows, the mouth does not protrude as much as the bulge 23 of the nose. Although the fabric from rear sheet 12 between mouth seam 21 does not stretch, it can curve inward. Therefore, it tends to move inward as the front sheet protrudes. If filling 40, which is behind rear sheet 12, is packed less tightly than filling 27 filling 27 will collapse to some degree under the mouth. Conversely, filling 40 may be highly pressurized, which forces the entire structure, pieces 10 and 12, outward.

Sheet 12 may be provided with a small slit 18 (FIG. 4), which is aligned with cover slit 16. One can delay adding filling 29 to form bulge 23 until all fusing is completed. One then adds filling to the bulge through both slits 18 and 16.

The completed face is next integrated into the head. Back head piece 48 (FIG. 4) is attached to completed face. First, the bottom periphery of back head piece 48 is attached to the previously sewn-together front and rear pieces 10 and 12 so that a head cavity 50 is formed. Cavity 50 is then filled with soft material 40 to fill the head. Finally, the rest of the periphery is sewn to complete the head.

Cover 20 allows for a greater bulge than if only the front and rear sheets 10 and 12 are used. First, it is relatively small and does not stretch so it does not flex as much. Moreover, the filling in cavity 50 behind rear sheet 12 and the filling between cover 20 and rear sheet 12 and applies force. This force is transmitted forward to cause the nose to bulge.

This technique is not limited to the nose. The nose is used in the exemplary embodiment because a nose is usually the feature on a human face that protrudes forward, and it is one of the feature that flattens in prior art dolls. Some cartooon characters have features that are out of proportion to normal features. This invention can form those features. For example, cover 20 may be enlarged to cover both the nose and mouth. Then neither the nose nor mouth is attached to rear sheet 12, and the entire lower face is free to project greatly outward.

Optional stitches 53 (FIG. 4) extend through the eyes 26. They may not be objectional because they can form highlights or pupils in the eyes. Stitches 53 extend through back head piece 48 and are pulled tight to make eyes 26 indent (FIG. 4). One also can stitch from the base of the nose through the filling to the rear piece 48 to increase the strength of the nose and to add to the definition of the bottom of the nose. These stitches (not shown) located properly at the bottom of the nose can look like nostrils.

Various modifications and changes may be made in the configuration described above that come within the spirit of this invention. The invention embraces all such changes and modifications coming within the scope of the appended claims.

I claim:

1. A method of forming features in a fabric doll face comprising:

(a) outlining a feature on a front piece of fabric, the front piece of fabric being formed of stretchable material, the feature being in a form of a perimeter;

(b) attaching a middle cover of material that does not stretch to the front piece of fabric over the feature and forming a cavity therebetween and within the perimeter, the middle cover of material being smaller than the front piece of fabric;

(c) inserting filling material between the front piece of fabric and the middle cover inside the cavity; and (d) attaching a rear piece of fabric to the front piece of fabric over the middle cover, the rear piece of fabric being approximately the same size as the front piece and extending substantially beyond the feature.

2. The method of claim 1 further comprising adding additional filler material between the front and rear pieces of fabric at locations spaced from the feature.

3. The method of claim 2 further comprising inserting filling material between the rear piece of fabric and the middle cover.

4. The method of claim 1 further comprising the step of cutting a slit in the middle cover within the perimeter of the feature, wherein the step of pushing material between the front piece of fabric and the middle cover comprises the step of pushing such material through the slit.

5. The method of claim 1 further comprising attaching together a region of the front and rear pieces of fabric spaced away from the middle cover.

6. The method of claim 1 wherein the perimeter has an opening in a minor portion of the perimeter.

7. A doll face comprising:

(a) front and rear pieces of material attached together about their peripheries, the front piece of material being of a stretchable material and the rear piece of material is of a material that does not stretch;

(b) a middle piece of material between the front and rear pieces of material, the middle piece of material being smaller than the front and rear pieces of material;

(c) attaching means between the front piece of material and the middle piece for attaching the front and middle pieces of material together; and (d) the attaching means being in the form of a pattern, the pattern being in a form of a perimeter, filling material within the pattern between the front piece of material and the middle piece of material to create a bulge in the front piece of material within the pattern.

8. The doll face of claim 7 further comprising additional filling material between the front and rear pieces of material.

9. The doll face of claim 7 wherein the pattern has an opening in a minor portion of the perimeter.

10. A method of forming features in a fabric doll face comprising:

(a) outlining a feature on a front piece of fabric, the front piece of fabric being formed of stretchable material, the feature being in a form of a perimeter;

(b) attaching a middle cover of material that does not stretch to the front piece of fabric over the feature and forming a cavity therebetween and within the perimeter, the middle cover of material being spaced from the periphery of the front piece of fabric;

(c) inserting filling material between the front piece of fabric and the middle cover inside the cavity; and (d) attaching a rear piece of fabric to the front piece of fabric over the middle cover, the rear piece of fabric being approximately the same size as the front piece and extending substantially beyond the feature.

11. The method of claim 10 further comprising adding additional filler material between the front and rear pieces of fabric at locations spaced from the feature.

12. The method of claim 11 further comprising inserting filling material between the rear piece of fabric and the middle cover.

13. The method of claim 10 further comprising the step of cutting a slit in the middle cover within the perimeter of the feature, wherein the step of pushing soft material between the front piece of fabric and the middle cover comprises the step of pushing such material through the slit.

14. The method of claim 10 further comprising attaching together a region of the front and rear pieces of fabric sheet spaced from the middle cover.

15. The method of claim 10 wherein the perimeter has an opening in a minor portion of the perimeter.

16. A doll face comprising:

(a) front and rear pieces of material attached together about their peripheries, the front piece of material being of a stretchable material and the rear piece of material is of a material that does not stretch;

(b) a middle piece of material between the front and rear pieces of material, the middle piece of material being spaced from the periphery of the front and rear pieces of material;

(c) attaching means between the front piece of material and the middle piece for attaching the front and middle pieces of material together; and (d) the attaching means being in the form of a pattern, the pattern being in the form of a perimeter, filling material within the pattern between the front piece of material and the middle piece of material to create a bulge in the front piece of material within the pattern.

17. The doll face of claim 16 further comprising additional filling material between the front and rear pieces of material.

18. The doll face of claim 16 wherein the pattern has an opening in a minor portion of the perimeter.

19. A method of forming features in a fabric doll head comprising:

(a) outlining a feature on a front piece of fabric, the front piece of fabric being formed of stretchable material, the feature being in the form of a perimeter;

(b) attaching a middle cover of material that does not stretch to the front piece of fabric over the feature;

(c) inserting filling material between the front piece of fabric and the middle cover inside the perimeter;

(d) attaching a rear piece of fabric to the front piece of fabric over the middle cover and extending substantially beyond the feature to create a face;

(e) attaching the completed face along its periphery to a back sheet of fabric along at least a portion of the peripheries of the face and the back sheet of fabric; and (f) adding filling between the back sheet of fabric and the front and rear pieces of fabric with soft material and closing the remainder of the periphery between the front and rear pieces of material and the back sheet of fabric to create a doll head.

20. A doll head comprising:

(a) front and rear pieces of material attached together about their peripheries, the front piece of material being of a stretchable material and the rear piece of material is of a material that does not stretch;

(b) a middle piece of material between the front and rear pieces of material, the middle piece of material being smaller than the front and rear pieces of material;

(c) attaching means between the front piece of material and the middle piece for attaching the front and middle pieces of material together, the attaching means being in the form of a pattern, the pattern being in a form of a perimeter;

(d) filling material within the pattern between the front piece of material and the middle piece of material to create a bulge in the front piece of material within the pattern; and (e) a back piece of material behind the rear piece of material and additional filling material between the back piece and the rear piece of material to create a head.

21. The doll head of claim 20 wherein the pattern has an opening in a minor portion of the perimeter.

22. A method of forming features in a fabric doll head comprising:

(a) outlining a feature on a front piece of fabric, the feature being in the form of a perimeter, the front piece of fabric being formed of stretchable material, the front piece of fabric having a periphery;

(b) attaching a middle cover of material that does not stretch to the front piece of fabric over the feature, the middle cover being spaced from the periphery of the front piece of fabric;

(c) inserting filling material between the front piece of fabric and the middle cover inside the perimeter;

(d) attaching a rear piece of fabric to the front piece of fabric over the middle cover, the rear piece of fabric having a periphery spaced from the middle cover to create a face;

(e) attaching the completed face along its periphery to a back sheet of fabric along at least a portion of the peripheries of the face and the back sheet of fabric; and (f) adding filling between the back sheet of fabric and the front and rear pieces of fabric with soft material and closing the remainder of the periphery between the front and rear pieces of material and the back sheet of fabric to create a doll head.

23. A doll head comprising:

(a) front and rear pieces of material attached together about their peripheries, the front piece of material being of a stretchable material and the rear piece of material is of a material that does not stretch;

(b) a middle piece of material between the front and rear pieces of material, the middle piece of material being spaced from the peripheries of the front and rear pieces of material;

(c) attaching means between the front piece of material and the middle piece for attaching the front and middle pieces of material together, the attaching means being in the form of a pattern, the pattern being in the form of a perimeter;

(d) filling material within the pattern between the front piece of material and the middle piece of material to create a bulge in the front piece of material within the pattern; and (e) a back piece of material behind the rear piece of material and additional filling material between the back piece and the rear piece of material to create a head.

24. The doll head of claim 23 wherein the pattern has an opening in a minor portion of the perimeter.

* * * * *